US009567767B2

(12) United States Patent
Kendrick

(10) Patent No.: US 9,567,767 B2
(45) Date of Patent: Feb. 14, 2017

(54) VEHICLE ROOF-TOP TENT

(71) Applicant: Chad Kendrick, Turner Valley (CA)

(72) Inventor: Chad Kendrick, Turner Valley (CA)

(73) Assignee: TREELINE OUTDOORS, Turner Valley, Alberta ( * ) Notice: Subject to any disclaimer, the term of this patent is extended or adjusted under 35 U.S.C. 154(b) by 0 days.

(21) Appl. No.: 14/674,597

(22) Filed: Mar. 31, 2015

(65) Prior Publication Data

US 2016/0289996 A1 Oct. 6, 2016

(51) Int. Cl.
*E04H 15/06* (2006.01)
*E04H 15/34* (2006.01)

(52) U.S. Cl.
CPC ..... *E04H 15/06* (2013.01); *E04H 15/34* (2013.01)

(58) Field of Classification Search
CPC ..... E04H 15/06; B60P 3/38
USPC ..... 135/88.14, 88.16, 88.17, 88.18; 296/160, 296/161
See application file for complete search history.

(56) References Cited

U.S. PATENT DOCUMENTS 2,662,232 A * 12/1953 Daly ..... B60P 3/38 135/119
2,930,051 A * 3/1960 Kampmeier ..... B60P 3/38 135/88.16
3,375,836 A * 4/1968 Domeneghetti ..... E04H 15/06 135/116
3,702,617 A * 11/1972 Franzen ..... B60P 3/38 135/116
3,712,315 A * 1/1973 Franzen ..... B60P 3/38 135/132
3,742,966 A * 7/1973 Franzen ..... B60P 3/38 135/116
3,785,693 A * 1/1974 Fulton ..... B60P 3/38 135/116
3,844,300 A * 10/1974 Sanders ..... B60P 3/38 135/116
4,099,534 A * 7/1978 Corbin ..... E04H 15/06 135/150
4,471,793 A * 9/1984 Cattaneo ..... B60P 3/38 135/88.16
4,522,441 A * 6/1985 Allison ..... B60P 3/38 135/88.17
4,968,086 A * 11/1990 Macisaac ..... E04H 15/06 135/88.16

(Continued)

FOREIGN PATENT DOCUMENTS

DE 2420344 A1 * 11/1975 ..... B60P 3/38
FR 1190343 A * 10/1959 ..... B60P 3/38

*Primary Examiner* — Noah Chandler Hawk

(57) ABSTRACT

The present invention relates tents, and in particular, relates to various features and accessories for vehicle roof-top tents. The claimed inventions provide many advantages over tents in the prior art. For example, the roof-top design frees up space inside your vehicle, and height acts as a secondary safety defense against wildlife and ground-related elements. Other advantageous aspects of the claimed inventions include a superior curved frame, removable shoe bags, a roll up window awning, semicircular windows, a canopy PVC window, an aluminum honeycomb tent base, an advantageous stowing arrangement for the canopy pole, bungee cord pockets, dual PVC skylights and a quick release mounting for the vehicle roof rack. Other systems, methods, features and advantages of the invention are also described and presented in the figures and detailed description.

23 Claims, 17 Drawing Sheets

(56) References Cited

U.S. PATENT DOCUMENTS

| | | | | |
|---|---|---|---|---|
| 5,205,089 | A * | 4/1993 | Cunningham | E04H 15/06 135/132 |
| 6,463,948 | B2 * | 10/2002 | Lee | E04H 15/44 135/136 |
| 8,844,207 | B2 * | 9/2014 | Bowers | E04F 15/02038 428/900 |
| 2008/0308138 | A1 * | 12/2008 | Brochier | B60P 3/39 135/88.17 |

* cited by examiner

VEHICLE ROOF-TOP TENT

FIELD OF INVENTION

The present invention relates tents, and in particular, relates to various features and accessories for vehicle roof-top tents.

BACKGROUND OF THE INVENTION

Camping has been a popular recreation for many years. Although camper vans and motor homes are commonly used by campers, they are expensive and they do not allow the campers to enjoy a close experience with nature to the extent that canvas and fabric tents do. However, canvas and fabric tents are typically placed on the ground, exposing them to problems with dampness, puddles, mud, rocky or uneven ground, insects, small mammals and other pests. Larger mammals such as bears, are downright dangerous for campers in tents placed on the ground. As a result, many attempts have been made to offer tents which are elevated, being mounted for example, on the tops of cars, SUVs and vans, or in the beds of trucks.

But the current offerings of vehicle-mounted tents still have many undesirable features such as weight, bulkiness, slow and/or complicated set-up, lack of aesthetic or convenient features, and many loose parts to be stored.

There is therefore a need for an improved vehicle-mounted tent and accessories.

SUMMARY OF THE INVENTION

It is an object of the invention to provide an improved vehicle-mounted tent and accessories.

According to one aspect of the present invention there is provided a vehicle roof-mounted tent comprising a base including: a fixed portion for mounting on the roof of the vehicle and a pivoting portion connected to the fixed portion, the pivoting portion being arranged to pivot away from the vehicle. The tent also comprises a main tent portion, generally of tent fabric, including a pivoting frame, the main tent portion being positioned over the fixed and pivotal portions of the base; and a canopy portion, generally of tent fabric, extending beyond the end of the pivoting portion of the base.

According to another aspect of the present invention there is provided a tent for mounting on the roof of a vehicle comprising: a base including a fixed portion for mounting on the roof of the vehicle and a pivoting portion connected to the fixed portion, the pivoting portion being arranged to pivot away from the vehicle. The tent also comprises a main tent portion of tent fabric, including: a pivoting frame; a door; and at least one window on a roof surface to serve as a skylight; the main tent portion being positioned over the fixed and pivotal portions of the base; a canopy portion of tent fabric, extending beyond the end of the pivoting portion of the base; a rain fly, comprising a PVC window positioned above the window on the roof surface of the main tent, the rain fly being positioned over the main tent portion and the canopy portion; and an access ladder pivotally connected to the end of the pivoting portion of the base.

As explained herein after, the claimed inventions provide many advantages over tents in the prior art. For example, the roof-top design frees up space inside your vehicle, and height provides a defense against wildlife and ground-related elements. Other advantageous aspects of the claimed inventions include a superior curved frame, removable shoe/utility bags, a roll-up window awning, large semicircular windows, a canopy PVC window, aluminum honeycomb tent base, an advantageous stowing arrangement for the canopy pole, bungee cord pockets, dual PVC skylights and a quick release mounting for the vehicle roof rack.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

These and other features of the invention will become more apparent from the following description in which reference is made to the appended drawings wherein.

DETAILED DESCRIPTION

One or more currently preferred embodiments have been described by way of example. It will be apparent to persons skilled in the art that a number of variations and modifications can be made without departing from the scope of the invention as defined in the claims.

The preferred embodiment of the tent features a rugged, lightweight aluminum honeycomb base and dual skylights that allow for extra natural light even while the fly is on. Oversized awning windows can be rolled up for unrestricted views. Other unique features include utility storage bags and a hi-tech Diamond Ripstop rain fly. The tent can be set up and taken down in minutes, and comes with a built-in, cloth covered, high density foam mattress that can stay inside the tent during travel. The new curved design reduces weight, improves water shedding and improves aerodynamics.

Figure 1:
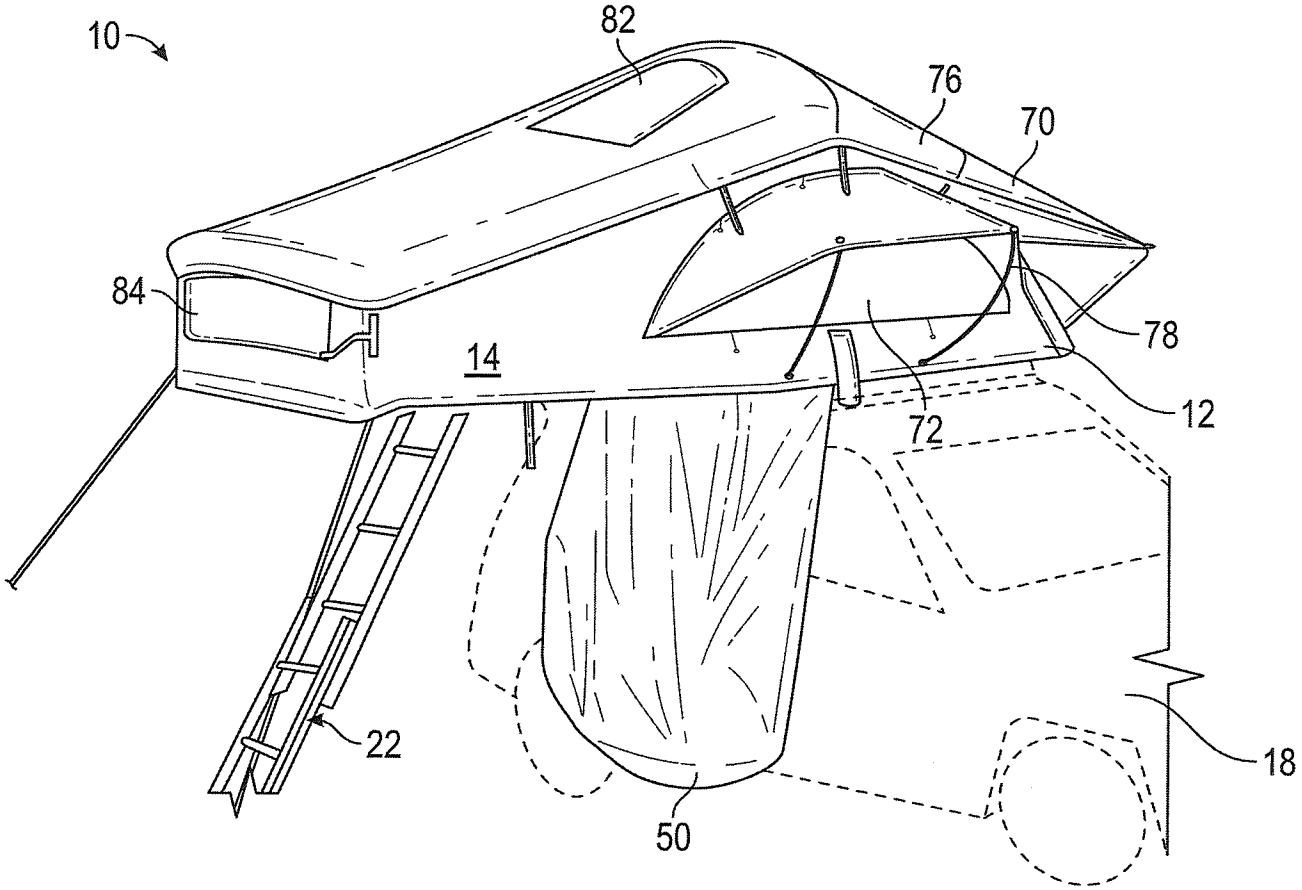
FIG. 1 shows a front perspective view of a tent in accordance with an embodiment of the present invention, having dual sky lights, in the deployed position on the roof of a vehicle, with the rain fly installed and the front awning deployed.
Figure 2:
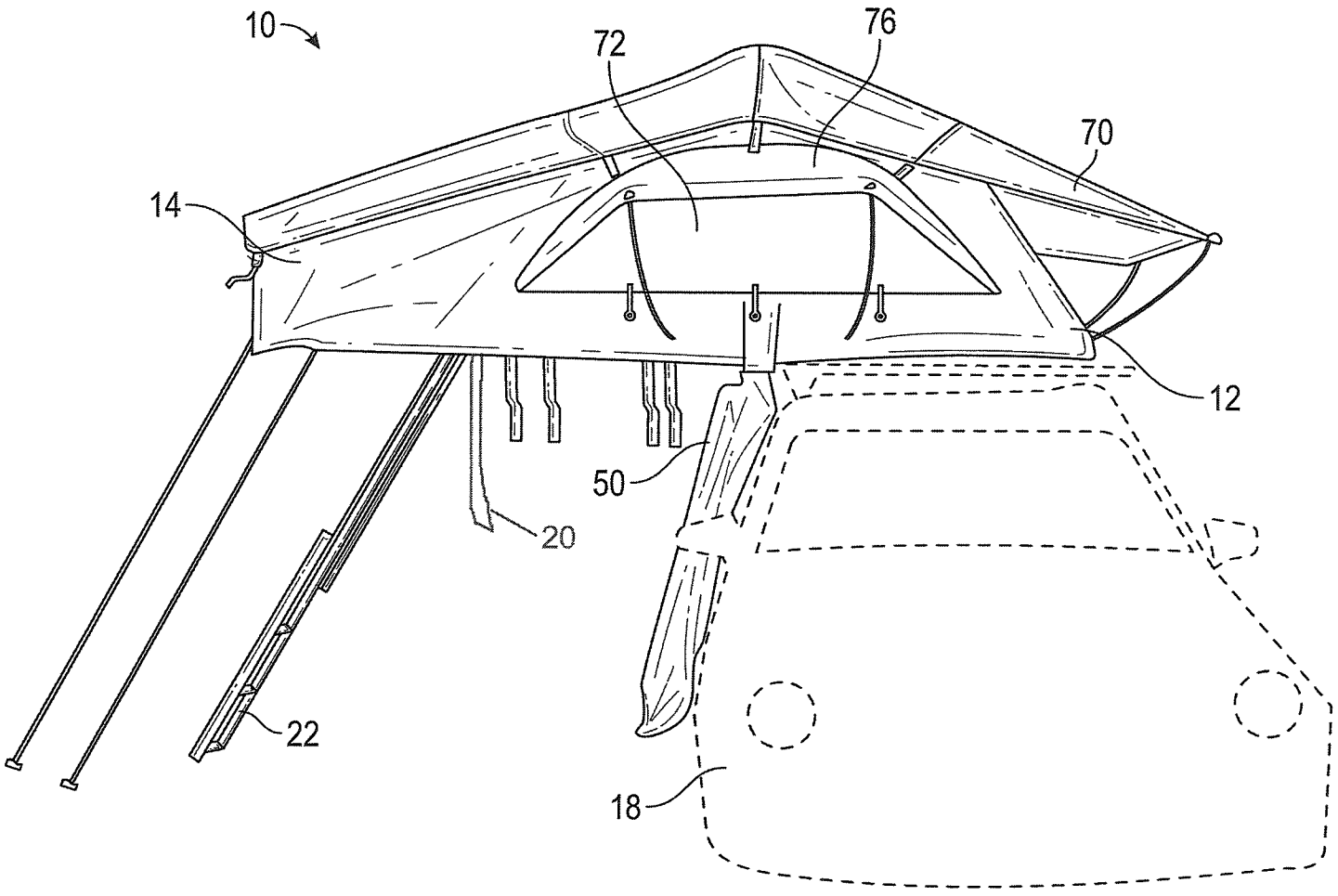
FIG. 2 shows a front view of the arrangement of FIG. 1, in accordance with an embodiment of the present invention.
Figure 3:
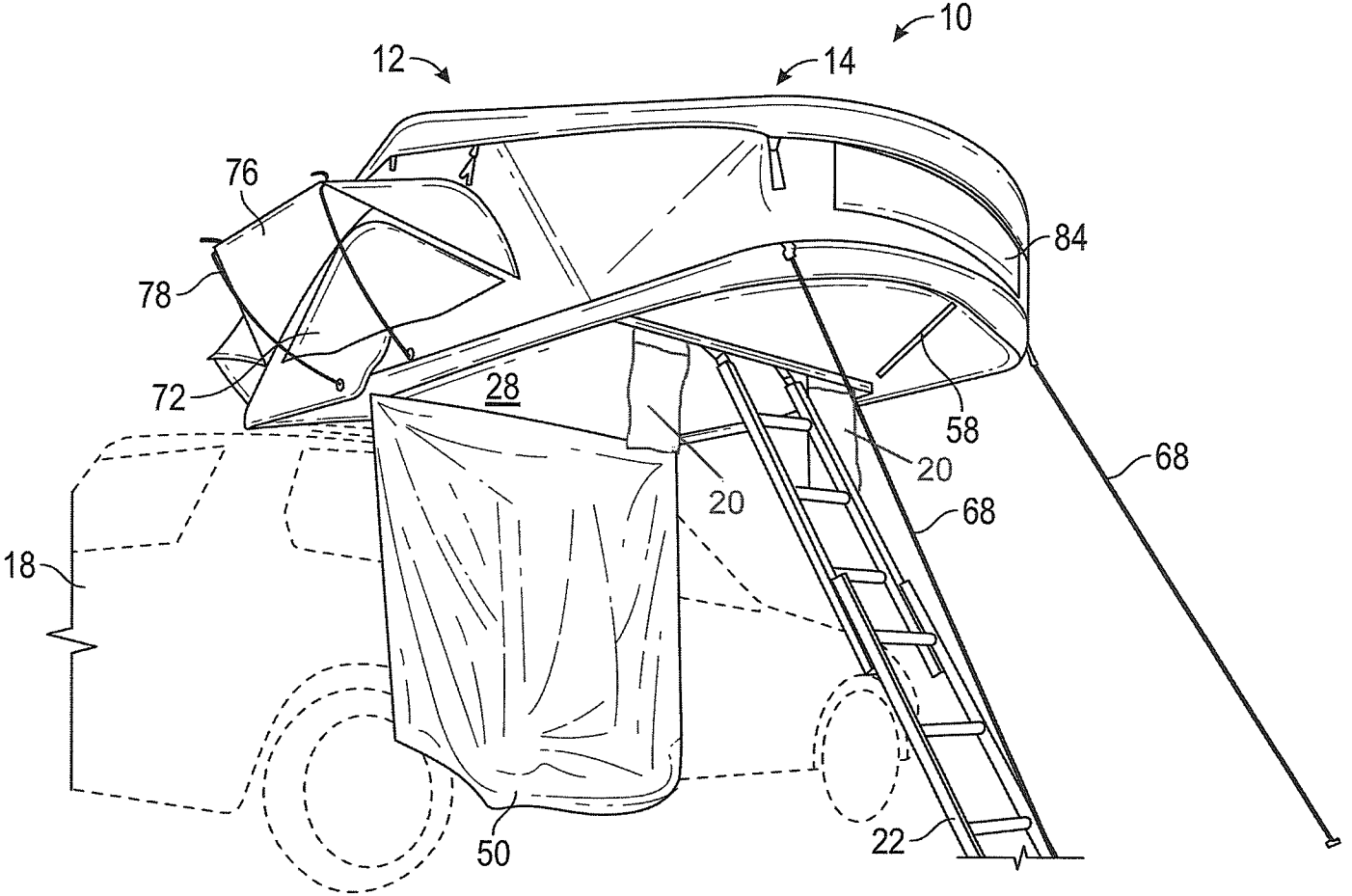
FIG. 3 shows a perspective view of the arrangement of FIG. 1, in accordance with an embodiment of the present invention, from the rear, canopy side and below.

As shown in FIGS. 1, 2 and 3, the preferred tent 10 is not symmetrical when viewed from the exterior, consisting of a main portion 12 and an extended canopy portion 14. The main portion 12 of the tent 10 has a base 16 which rests on and is clamped to a conventional rack 46 on the roof-top of a vehicle 18, but also cantilevers out from the vehicle 18 somewhat, as shown in FIG. 3. The extended canopy portion 14 provides additional shelter outside the vehicle 18, as well as providing some protection for the accessory/shoe bags 20 and access ladder 22 from the elements.

Figure 4:
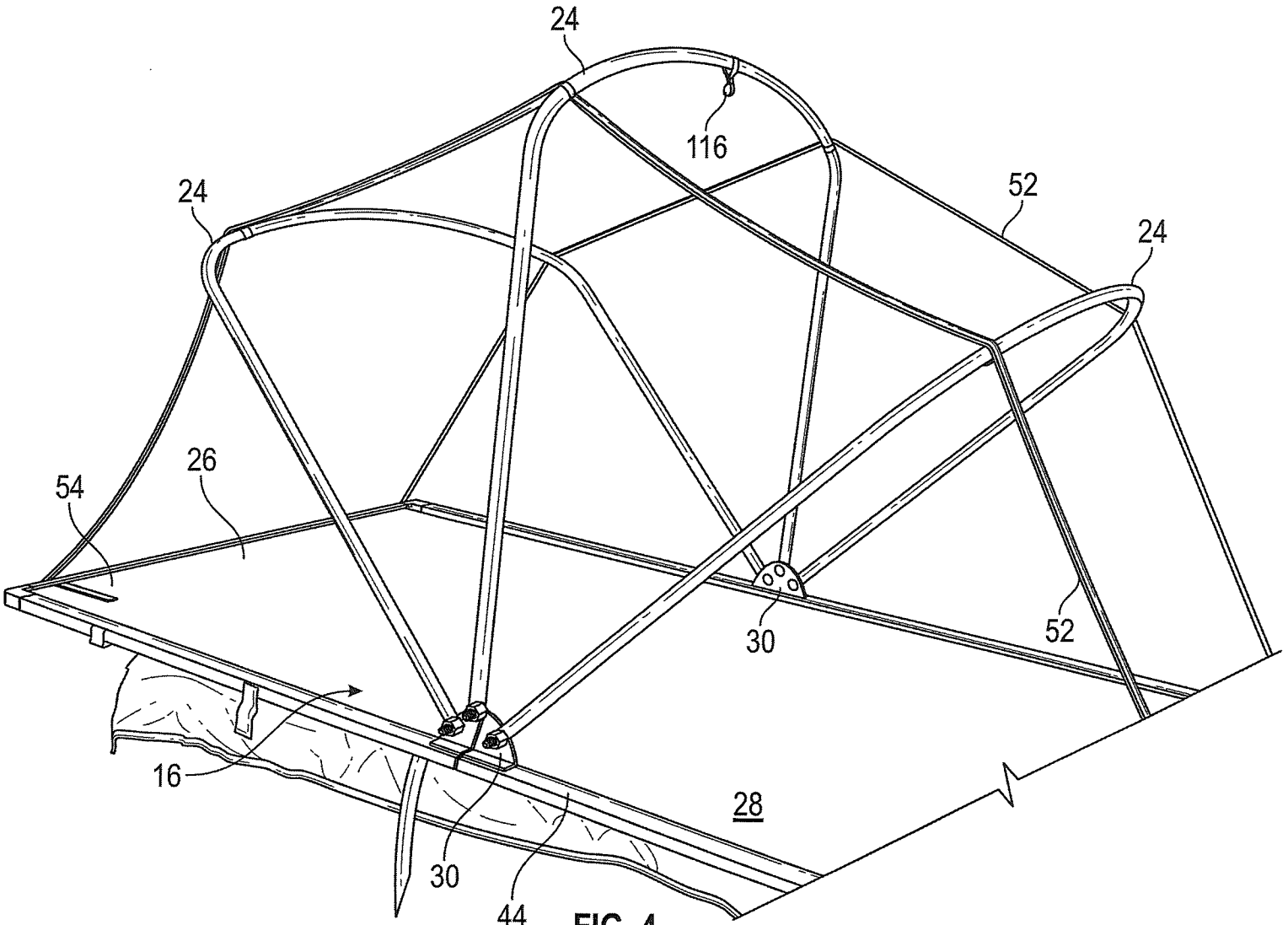
FIG. 4 shows a perspective view of the interior frame and base portions of a tent in accordance with an embodiment of the present invention.

As shown in FIG. 4, the main portion 12 of the tent 10 is supported by a system of three frame poles 24 which are pivotally connected to the base 16. The base 16 consists of two portions, which are hinged together with a pair of brackets 30. One portion of the base 16 is fixed to the vehicle while in use (i.e. 'the fixed portion of the base 26'), while the other portion of the base 16 (i.e. 'the pivoting portion of the base 28') pivots between a stowed position in which it lies over the fixed portion of the base 26, and a deployed position in which it cantilevers out from the vehicle 18. The pair of brackets 30 have flange-like members which stand off from the surface of the fixed 26 and pivoting 28 portions of the base 16, provide a pivot point that is raised from the surface of the fixed 26 and pivoting portions 28 of the base 16. In this way, the fixed 26 and pivoting 28 portions of the base 16 are spaced apart from one another in the stowed position, leaving room for the mattress 32 and the three frame poles 24. In the preferred embodiment the fixed 26 and pivoting 28 portions of the base 16 will be spaced apart by about 8½", although other dimensions could also be used. The three frame poles 24 are connected to the pair of brackets 30 on the base 16, so that they pivot as the tent 10 is assembled or stowed. The pivot points for the three frame poles 24 are spaced apart on the brackets 30, so that they do not interfere with one another.

Figure 5:
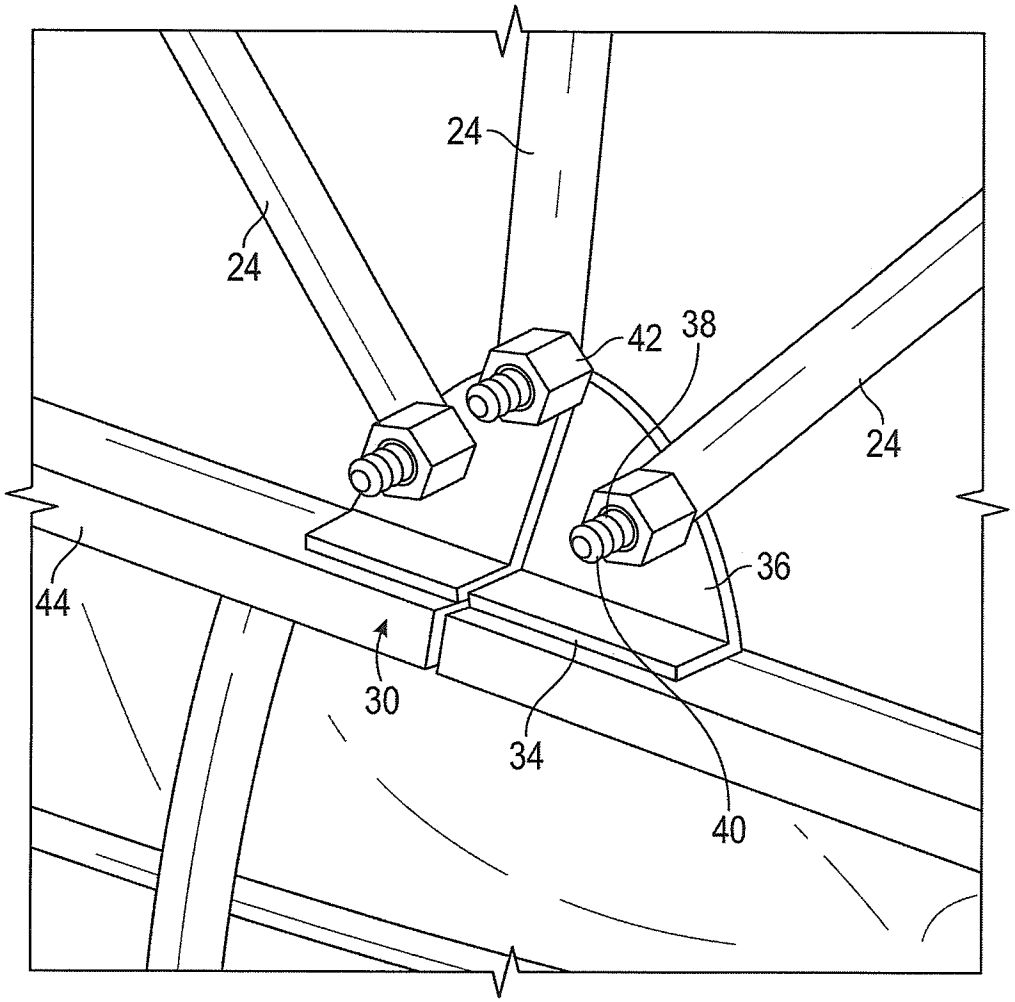
FIG. 5 shows a detailed view of one of the pairs of brackets in accordance with an embodiment of the present invention.

A detail of one of the pair of brackets 30 is shown in FIG. 5. As shown, each of the brackets 30 consists of two parts, each part having a foot 34 which is screwed to the U-channel of the base 16, and an upright portion 36 having two holes. Each of the three frame poles 24 terminates in a clevis or yoke 38 that is attached to the frame pole 24 with a screw. The devises or yokes 38 allow the three frame poles 24 to pivot with respect to the upright portions 36 of the brackets 30, being attached with a bolt and a nylon nut 40 or locknut arrangement. Note that the middle bolt 42 passes through two upright portions 36 of the bracket 30 as well as through the clevis or yoke 38 of the middle frame pole, so that the two parts of the bracket 30 can pivot with respect to one another.

The fixed 26 and pivoting 28 portions of the base 16 are preferably fabricated from 23 mm thick aluminum honeycomb, with a U-shaped channel 44 fixed about the perimeter. Other thicknesses of aluminum honeycomb could be used, or other materials which have sufficient strength to provide the desired cantilever distance. For example, the base 16 could be fabricated from an aluminum frame filled with polyurethane foam, covered on both sides with a 0.4 mm aluminum sheet. The aluminum honeycomb base described herein has dimensions of 310 cm length×143 cm width. As a result, the preferred embodiment of the tent as described herein has the following dimensions:

- tent dimensions open: 310 cm length×143 cm width×126 cm height (i.e. this is the sleeping are, not including the canopy);
- tent dimensions closed: 125 cm length×143 cm width×30 cm height;
- mattress: 240 cm length×140 cm width×6 cm height;
- total pack size: 150 cm length×125 cm width×30 cm height; and
- weight: 97 lbs.

This arrangement fits on a vehicle with a roof rack 46 wider than 37 inches, and can be adjusted to fit roof racks 46 smaller than 37 inches with minor modifications.

Figure 7:
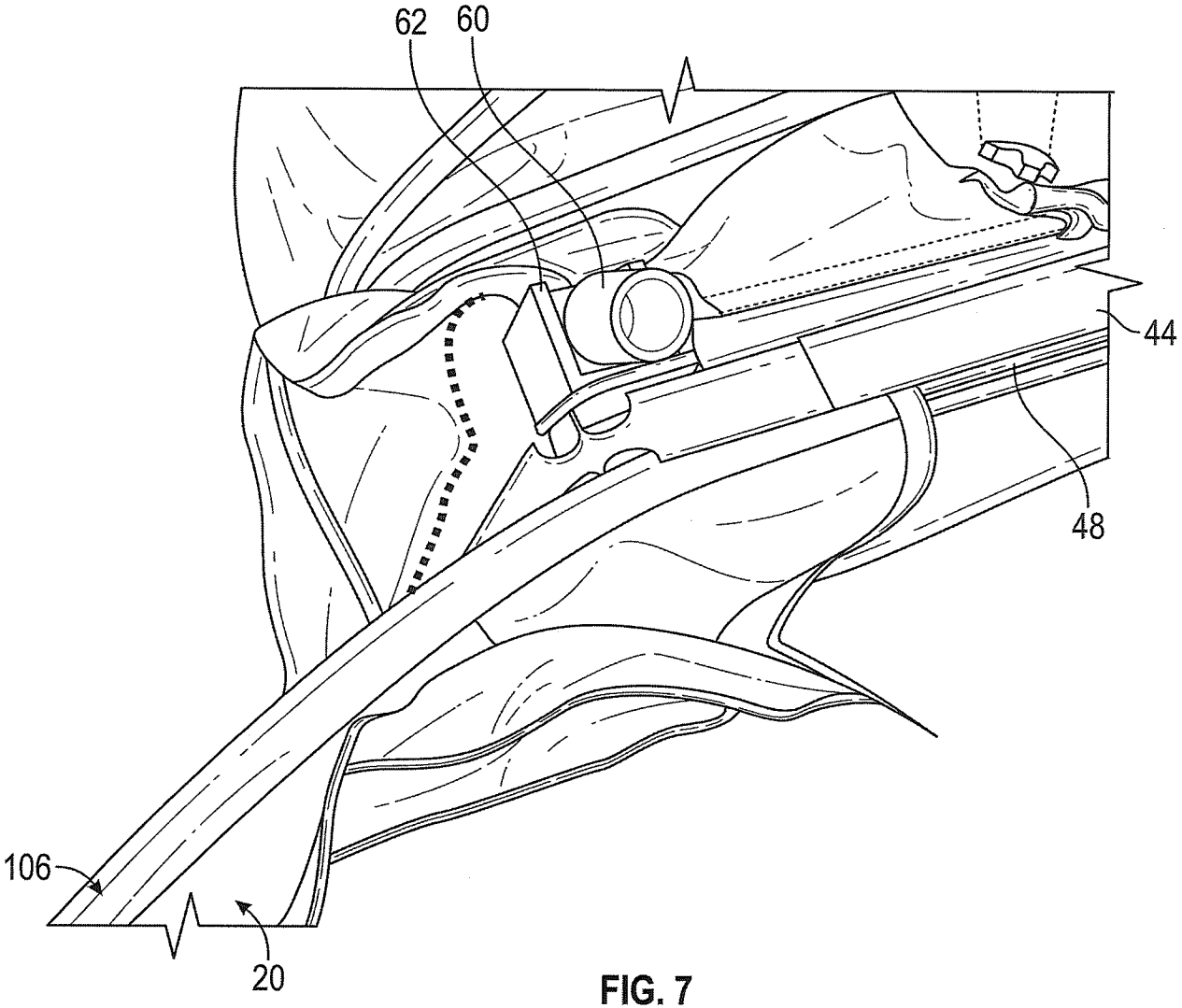

The U-shaped channel 44 fixed about the perimeter of the base 16 has a groove 48 on the underside (see FIGS. 7 and 12A), which is used to hold the travel cover 50 and to hold the tent fabric in the conventional manner. But as will be explained hereinafter, this groove 48 is also used to support the removable shoe/utility bags 20.

The frame arrangement in the main portion 12 of the tent 10 is generally symmetrical. The three pivoting frame poles 24 may have slightly different sizes so that they nest together, or they may be the same size so that they lay on top of one another in the stowed position. The three pivoting frame poles 24 are preferably ¾" diameter aluminum, which is light and sufficiently strong for this application. Steel poles would be less expensive, but would be heavier than aluminum. Smaller diameter or light gauge aluminum could be used, but it would be less durable. Fibreglass or other materials may also be used as known to one skilled in the art. Because the three pivoting frame poles 24 have a small outside diameter, it is not necessary for them to nest together in order to provide a low-profile in the stowed position. Thus, it is preferred that they all be the same size.

The system of three pivoting frame poles 24 are connected together by fabric straps 52. At one end, the fabric straps 52 are attached to the outside edge 54 of the fixed portion of the base, while at the other end, they are connected to the outside edge 56 of the pivoting portion of the base. The fabric straps 52 are also frictionally engaged at specific positions on the three pivoting frame poles 24 so that the tent 10 has the desired shape in the assembled state. Thus, when the two base portions 26, 28 are pivoted into the deployed position, the fabric straps 52 will draw the three pivoting frame poles 24 with them, pivoting them into evenly spaced arrangement about the pair of brackets 30 on the base 16. Conversely, when the two base portions 26, 28 are pivoted into the stowed position, the fabric straps 52 will relax and allow the three pivoting frame poles 24 to pivot back into the stowed position. The two fabric straps 52 shown in FIG. 4 are simply sewn into a loop at each point in which they cross the three pivoting frame poles 24, so the fabric straps 52 are in frictional engagement with the three pivoting frame poles 24. The fabric straps 52 could be fixed to the three pivoting frame poles 24, for example, using a single screw through the fabric straps 52, but this is generally not necessary.

Figure 6:
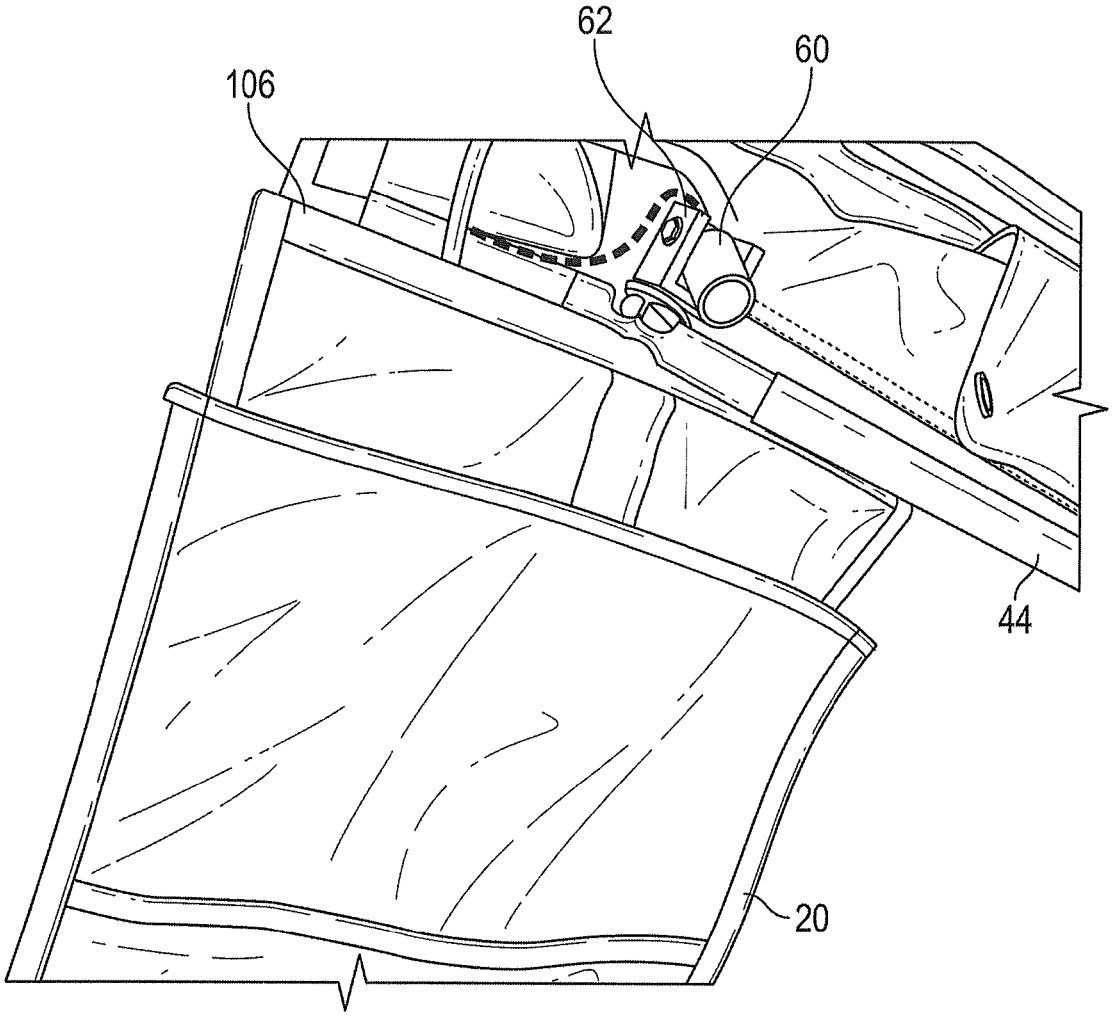
FIGS. 6 and 7 show perspective views of a socket to support the canopy pole, in accordance with an embodiment of the present invention.
Figure 8:
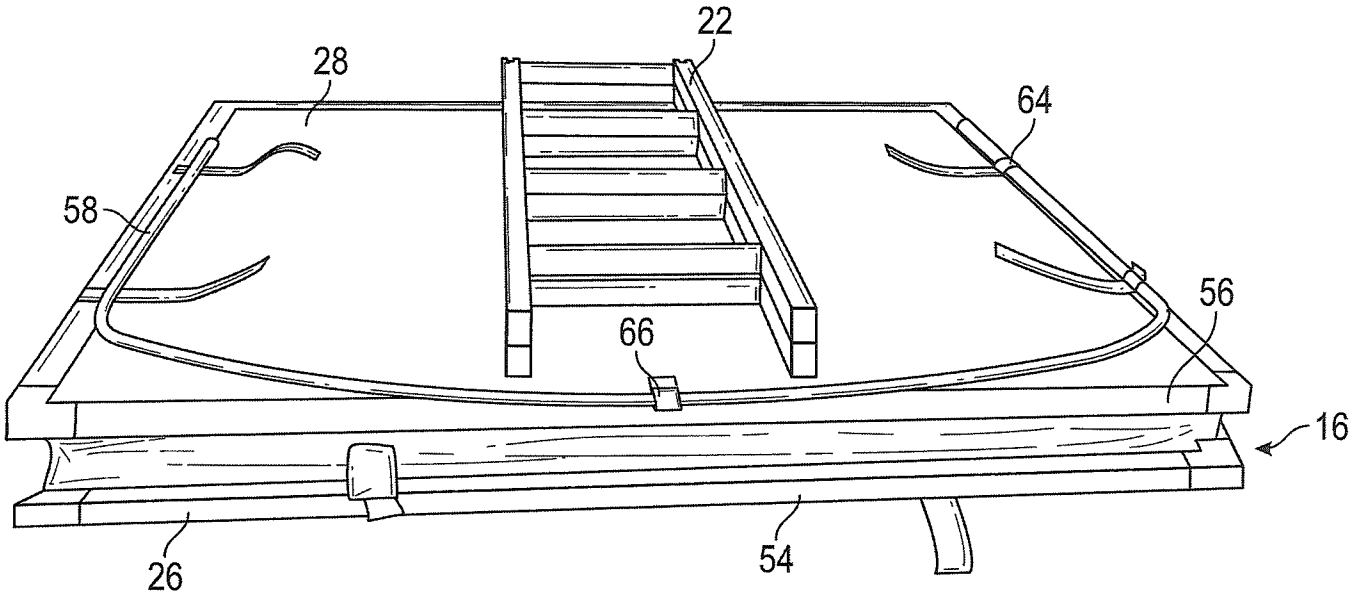
FIG. 8 shows a top perspective view of the tent with the pivoting portion of the base in the stowed position, the ladder in the contracted and stowed position, and the canopy pole in a stowed position, in accordance with an embodiment of the present invention.

The extended canopy 14 has an additional frame member, the canopy pole 58, which is connected to the pivoting portion of the base 28 by way of a pair of sockets 60 which pivot in yokes or devises 62 (see FIGS. 6 and 7), fixed to the outside edge of the pivoting portion of the base 28 (see FIG. 3). The canopy pole 58 is removed completely when the tent 10 is disassembled and can be stowed on the top of the base 16 as shown in FIG. 8. In the preferred arrangement, the canopy pole 58 slides through the four loops 64 on the sides of the base 16, and is fixed in position with a single loop 66 of Velcro. When the tent 10 is assembled, the ends of the canopy pole 58 are fitted into the sockets 60, and the canopy pole 58 is rotated into position, supporting the tent fabric over the extended canopy 14. The extended canopy 14 is also deployed by way of a pair of guy lines 68 which are fixed to the ground with conventional stakes or pegs per FIGS. 2 and 3. The canopy pole 58 is preferably fabricated from ¾" diameter aluminum, like the three pivoting frame poles 24.

All of the three pivoting frame poles 24 and the canopy pole 58 have curved profiles. Combining these curved profiles with the profile along the perpendicular axis of the tent 10 (i.e. the long axis of the tent), provides a curved aerodynamic design in all dimensions. This results in less noise inside the tent 10 on a windy day, along with less likelihood of damage. As well, it allows rain and other precipitation to roll off of the tent 10 more easily than in designs with flatter, horizontal surfaces. Preferably, the tent 10 should have the curvature as shown in the drawings, but the precise curvature is a trade-off between the amount of space inside the tent 10, and the degree of aerodynamics and precipitation runoff that would be provided. In other words, having less curvature (i.e. a larger curvature radius) would provide more room inside the tent 10, but poorer aerodynamics and reduced ability to shed precipitation.

The tent 10 itself is fabricated from water resistant 280 g Poly Cotton with flame retardant, PU (polyurethane waterproofing) and mold/mildew resistant coating. The rain fly 70 is fabricated from 420denier waterproof Diamond Ripstop Polyester with flame retardant, PU and mold/mildew resistant coating. The travel cover 50 is fabricated from 2000 denier PVC coated durable polyester. The precise dimensions of the tent 10, rain fly 70 and travel cover 50 follow directly from the dimensions of the base 16 and frame.

Figure 9:
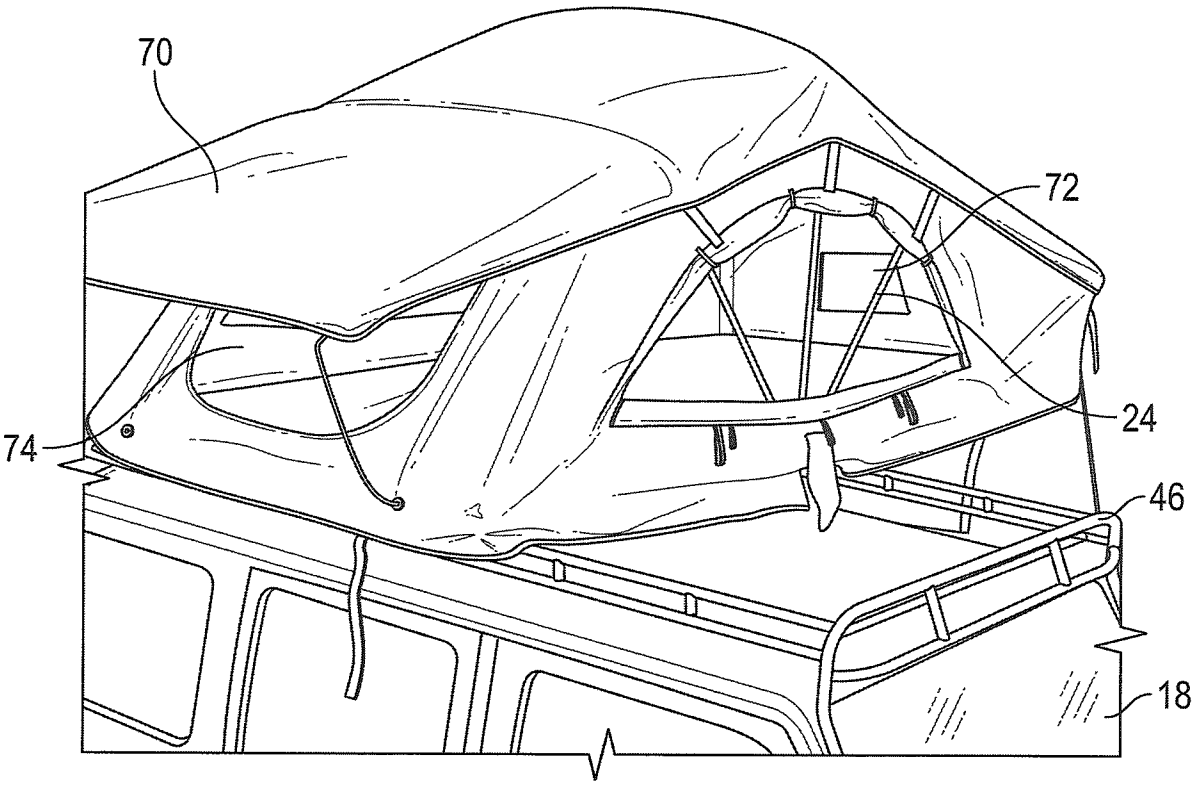
FIG. 9 shows a rear perspective view of a tent in accordance with an embodiment of the present invention, having no sky lights, in the deployed position on the roof of a vehicle, with the rain fly installed and the rear awning stowed.
Figure 10:
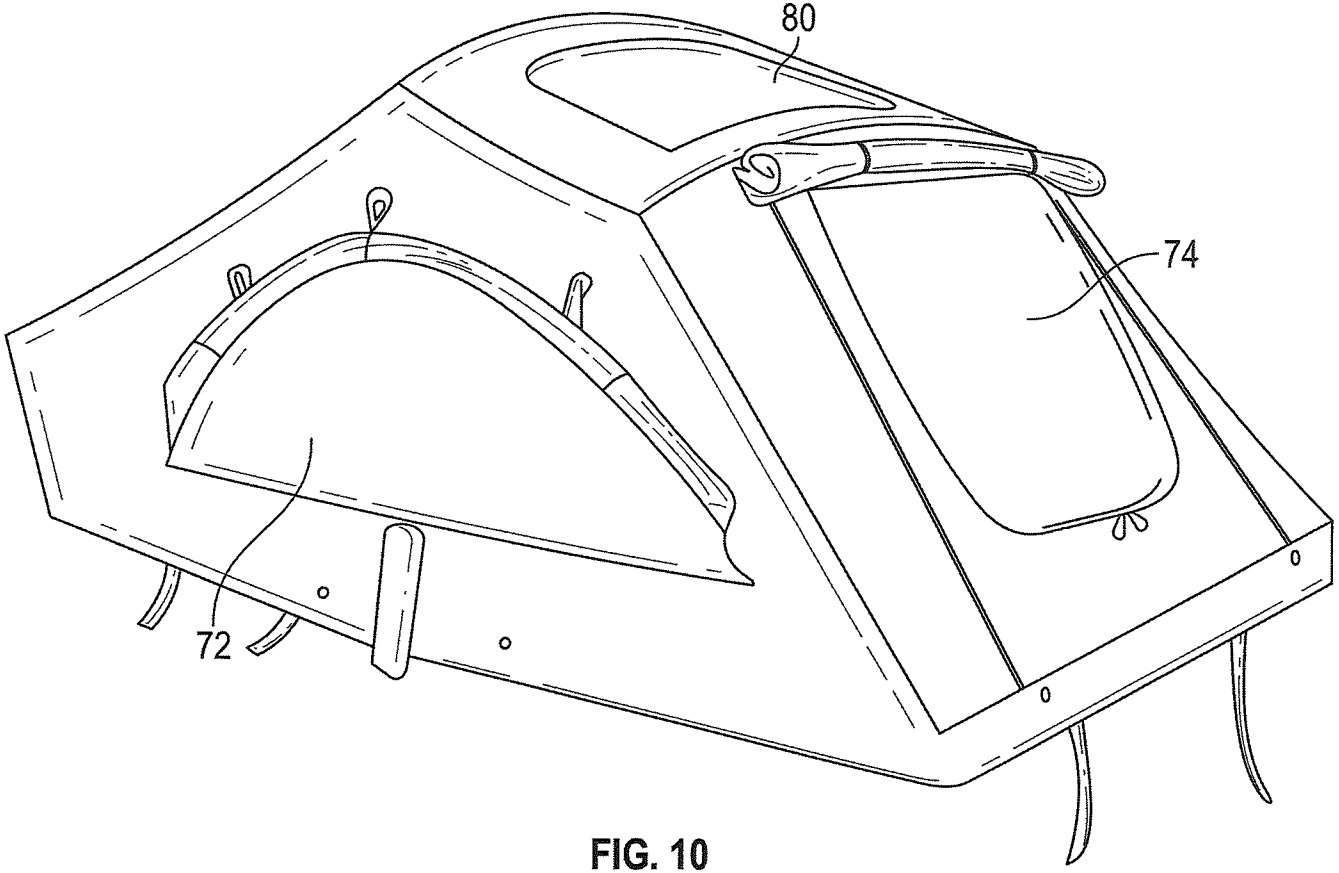
FIG. 10 shows a front perspective view of a tent in accordance with an embodiment of the present invention, having dual sky lights, in the deployed position, without the rain fly installed, and with the front awning in a stowed position.

As shown in FIGS. 9 and 10 the tent 10 preferable has large windows 72 on both sides, and on the end of the tent 74 over of the fixed portion of the base. The windows 72, 74 themselves are fabricated from "no-see-um mesh", that is, extra-fine gauge netting which keeps out even very small bugs. Such netting is available in very sheer form which maintains a high level of visibility. The windows 72, 74 are fully zippered in that the mesh is held to the tent fabric by zippers, as are the window covers. The windows 72, 74 are also provided with a cover of tent fabric which can be unzipped and secured above with a loop and bone system.

The windows 72, 74 are larger than those typically used, both in terms of height and width. The larger size provides for more light inside the tent 10, better ventilation and better viewing for campers. The larger window size for the side windows 72 is facilitated in part by the use of the generally semi-circular shape; typical windows in the prior art are quite square or rectangular. The windows 72, 74 are also equipped with awnings, which consist of sheets of fabric double-sewed to the tent above each window 72, 74. While awnings are available on prior art tents, it was found that the existing awnings were not effective with the larger semi-circular side windows 72 of the invention. The existing awnings were not shaped properly to be fitted across the entirety of the arcuate upper profile of the windows, resulting in a bunching of loose material when they were deployed. In order to obtain awnings 76 that properly fit the arcuate upper profile of the side windows 72, so they could be connected all the way to the horizontal edge of the side windows 72, awnings were roughly installed and then the superfluous material was removed. These new rounded awnings 76 are double-sewn to the tent fabric, and are extend out from the tent 10 using conventional curved steel rods 78 as shown in FIGS. 1 and 3. The awnings 76 can be rolled-up or furled, being held with a typical loop, and bone system.

As shown in FIGS. 1 and 10 the tent 10 preferably has dual skylights 80 on the 'roof' of the tent 10, with PVC windows 82 in corresponding locations on the rain fly 70. This provides additional light into the tent 10 during the day, as well as a view of the sky at night. The PVC windows 82 are sheets of frost-proof PVC, which has been double-sewn into the fabric of the rain fly 70. The skylights 80 in the tent 10 itself may either be a similar arrangement (i.e. PVC windows that have been double-sewn into the tent fabric) or may be the same arrangement as the side and end windows 72, 74 (i.e. a window of "no-see-um" mesh with a flap of tent fabric, both of which are zippered onto the tent fabric). Other than the skylights and the curvature/dimensions of the rain fly 70, the rain fly 70 is of generally conventional design being extended from the tent 10 with steel fly poles and/or guy lines. Note that the extended canopy 14 also has a PVC window 84 fabricated in the same way as the rain fly skylights 82, using PVC which has been double-sewn into the fabric of the tent 10 (see FIG. 3).

Figure 11A:
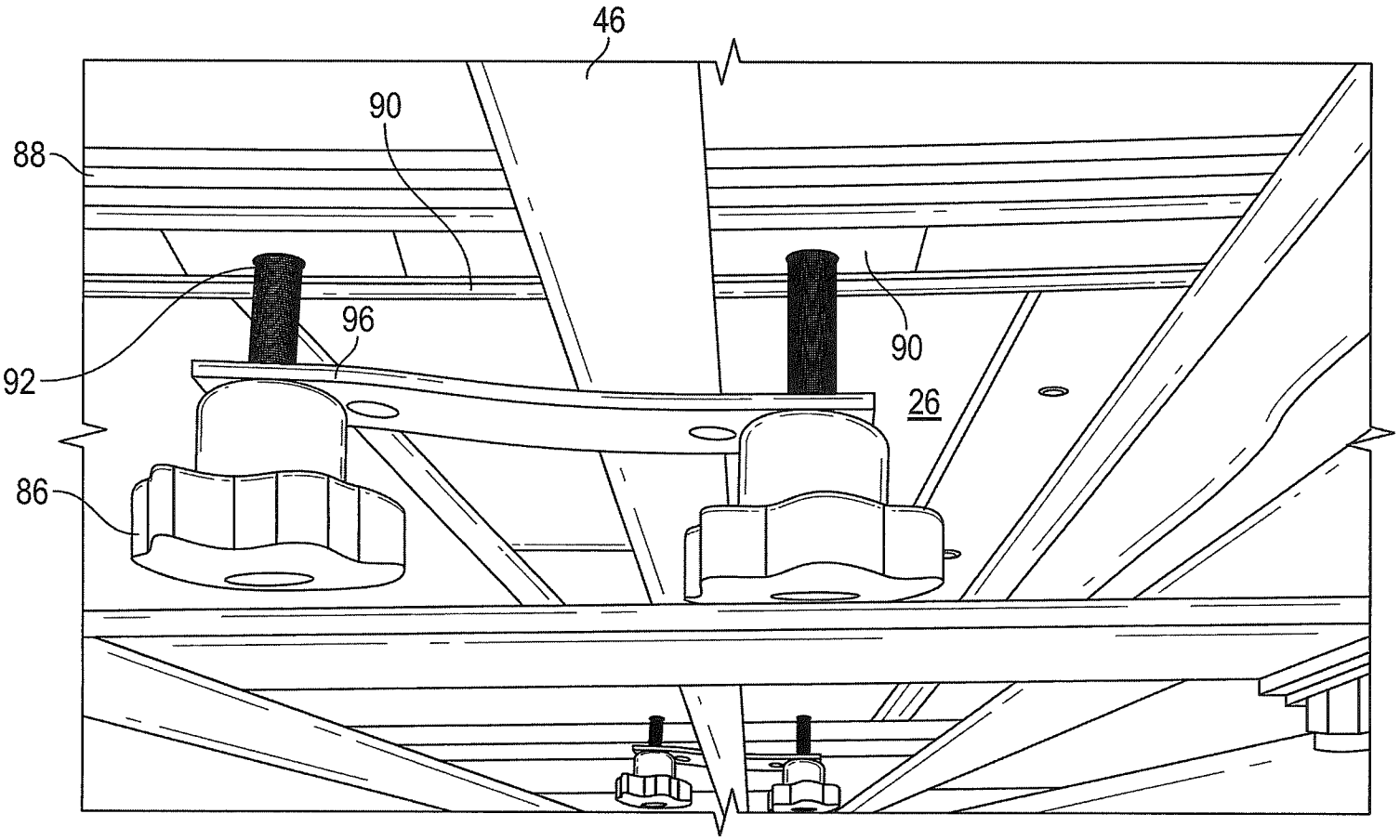
FIGS. 11*a*, 11*b* and 11*c* shows details of the quick-release mounting system in accordance with an embodiment of the present invention, FIG. 11*a* showing the installed arrangement, FIG. 11*b* showing the slides, threaded rods, plate and hand screws, and FIG. 11*c* showing a hand screw in isolation.
Figure 11C:
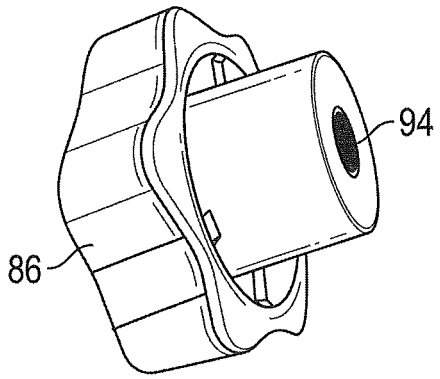
Figure 11D:
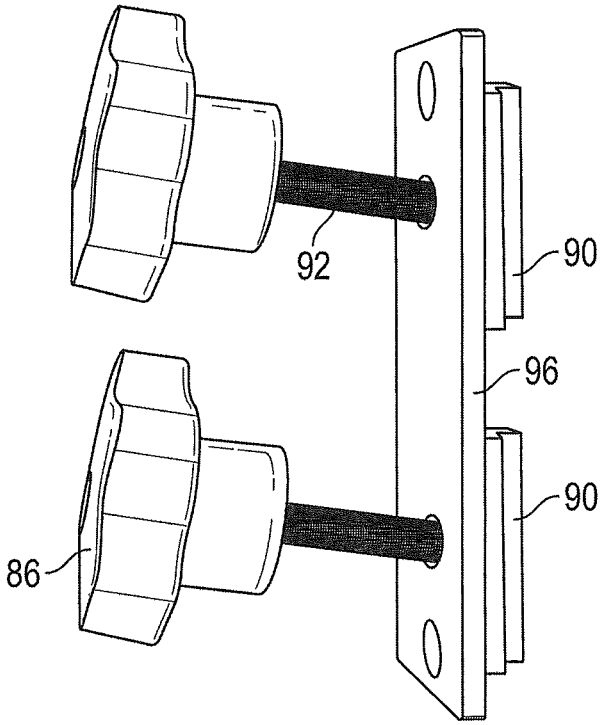

Quick release hand screws 86 as shown in FIGS. 11*a*, 11*b* and 11*c* are provided to facilitate easy installation and removal of the tent 10 from the roof rack 46 of a vehicle 18. Two U-shaped aluminum slide channels 88 are provided across the bottom of the fixed portion 26 of the base 16. These U-shaped slide channels 88 are configured with the open side down, allowing slide plates 90 to slide back and forth so their positions can be adjusted to accommodate the particular roof rack 46 on the vehicle 18. Each slide plate 90 has a threaded rod 92 extending from it, the threaded rod 92 comprising a carriage bolt or being tack-welded to the slide plate 90 (for example). Each hand screw 86 is of a knurled polymer construction and has an imbedded nut 94 which mates with the threaded rod 92. As shown in FIG. 11*a*, the hand screws 86 are used to sandwich an arm of the vehicle roof rack 46 between a plate 96 and the U-shaped slide channels 88. Four of such mounting arrangements would be used with the typical tent 10, although a different number of such assemblies could also be used, such as six. Other variations on this design could also be used such as adding locknuts or lockwashers, using steel materials instead of aluminum, and adding neoprene or rubber pads to reduce scratching or damage to components.

Figure 12A:
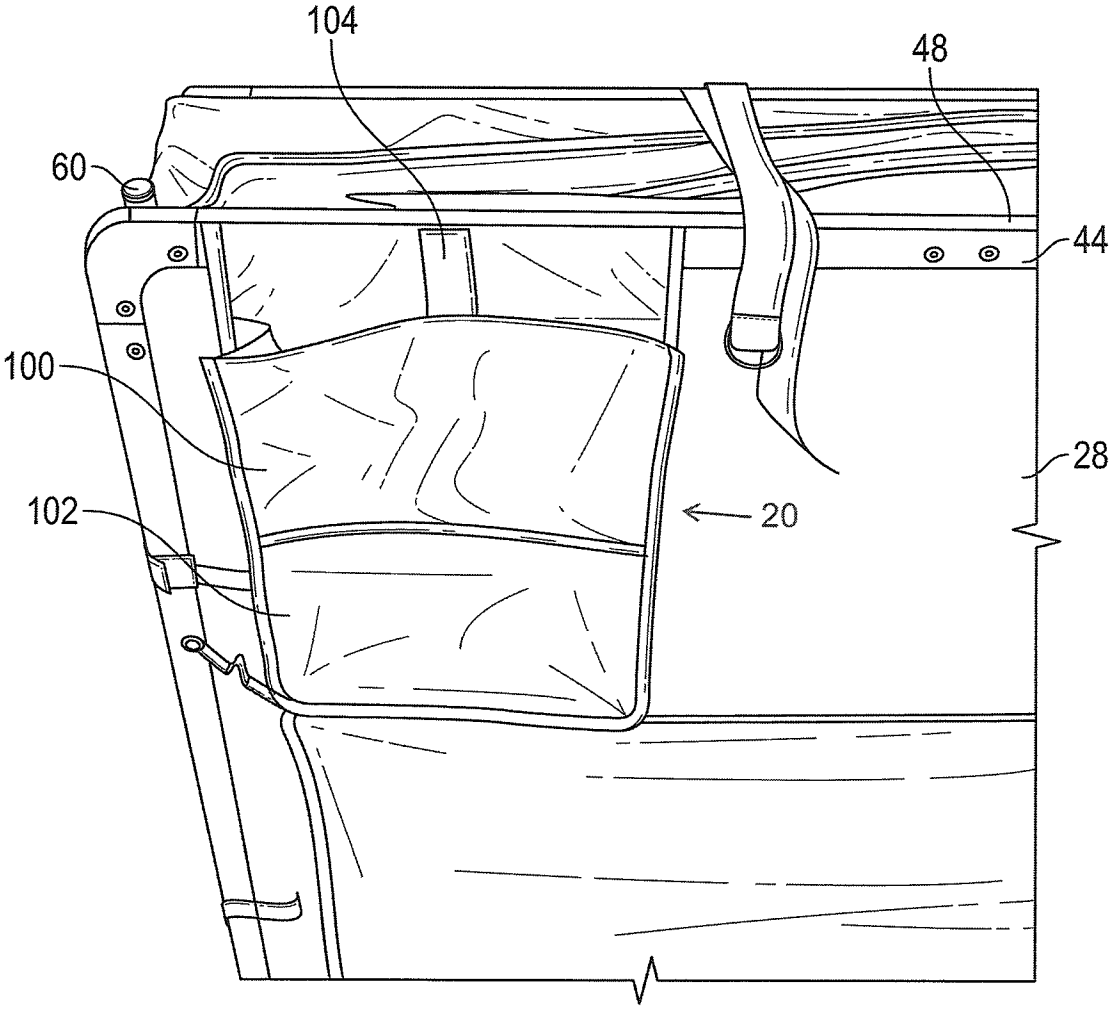
FIGS. 12*a* and 12*b* show the details of the shoe/utility bags in accordance with an embodiment of the present invention.
Figure 12B:
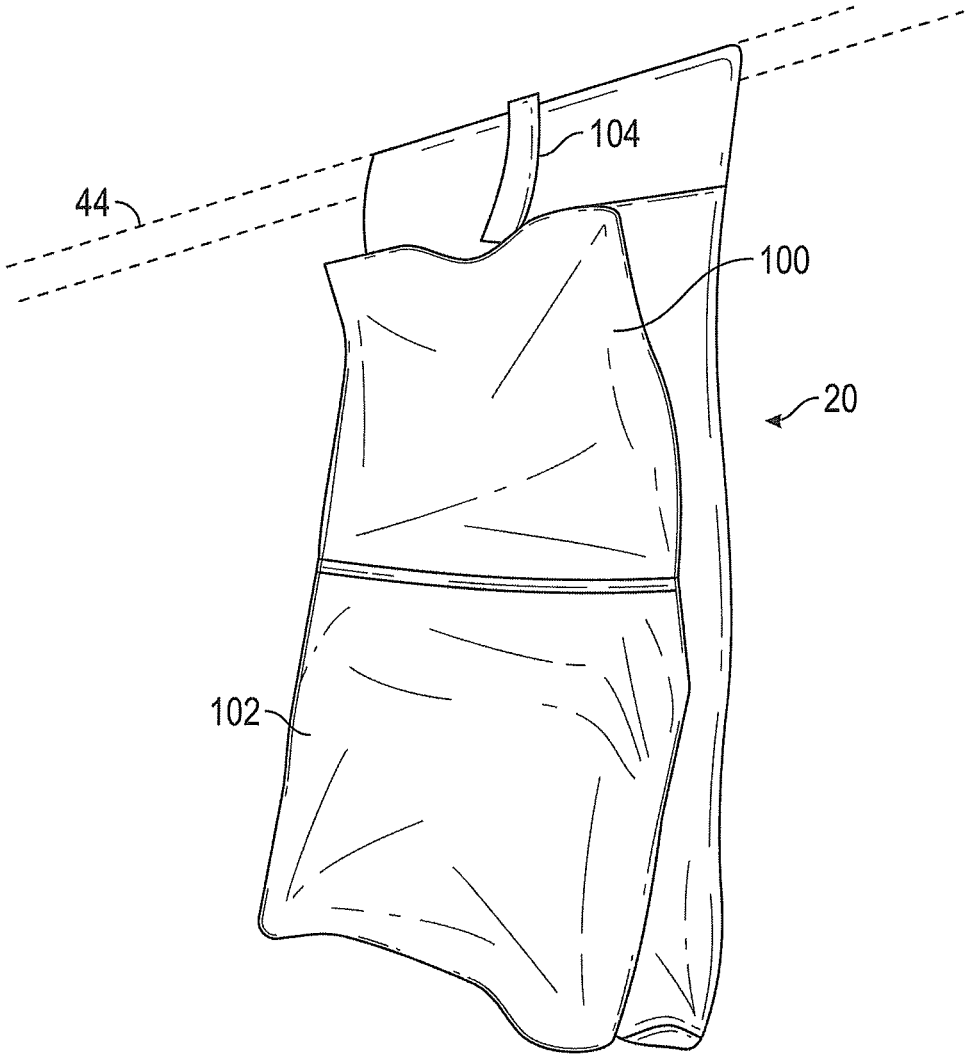

Removable shoe/utility storage bags 20 are provided as shown in FIGS. 12*a* and 12*b*. The removable shoe/utility storage bags 20 are suspended from the pivoting portion of the base 28 as shown in FIG. 3, so the user can store his/her shoes before entering the tent 10. The removable shoe/utility storage bags 20 have two pockets: a large primary pocket 100 which is fabricated from rain fly fabric, and a smaller pocket 102 on the lower portion of the front which is formed from "no-see-um" material. The large primary pocket 100 can be closed with a Velcro strap 104 sewn into two portions of the removable shoe/utility storage bags 20. A piece of Velcro is also secured to the base 16 (not shown) so that the removable shoe/utility storage bags 20 can be secured during disassembly, or can be positioned out of the way during use. The removable shoe/utility storage bags 20 include a rubber rod 106 which is sewn into the top edge (see FIGS. 6 and 7). This rubber rod 106 is sized to mate with the groove 48 in the bottom edge of the U-channel 44. With this arrangement the user can slide the removable shoe/utility storage bags 20 sideways out of the groove 48 so that they can be removed completely.

Figure 14:
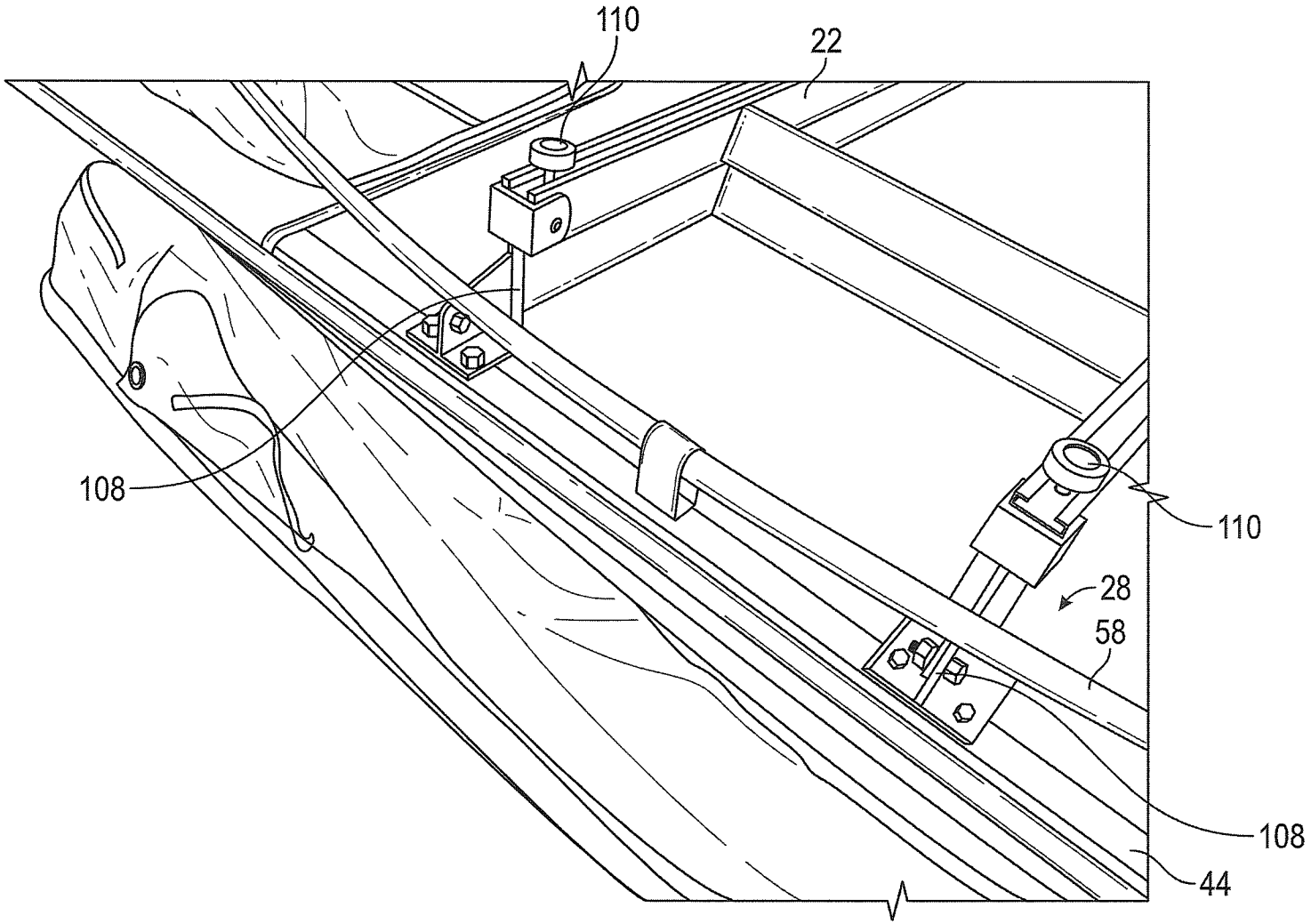
FIG. 14 shows a top view of the pivoting base portion in a stowed position, with the ladder and its support brackets installed, and with the canopy pole in a stowed position, in accordance with a further embodiment of the present invention.

The access ladder 22 preferably hinges to the underside of the pivoting portion of the base 28 using a pair of brackets 108, as shown in FIGS. 3 and 14. Thus, in the stowed position, the access ladder 22 rests on top of the pivoting portion of the base 28 as shown in FIG. 8. The access ladder 22 is of aluminum construction and is extendible. When the user wishes to unfold the tent 10 from the stowed position, he/she simply pulls on the bottom rung of the access ladder 22, and the access ladder 22 and pivoting portion of the base 28 will unfold to the deployed position. The access ladder 22 also has two adjustable pins 110, one on each rail (see FIG. 14). When the access ladder 22 is pulled out to the deployed position, these pins 110 may be set so that the access ladder 22 has the proper angle for access, and so that it bears part of the weight of the cantilevered pivoting portion of the base 28.

The access ladder 22 is also hinged to the underside of the pivoting portion of the base 28 so that it will not interfere with the door of the tent 10 (not shown). The door is fabricated with "no see um" mesh and tent fabric, both of which are zippered to the tent fabric. The door is positioned between the main portion of the tent 12 and the outside edge 56 of the pivoting portion of the base 28. The door material may be rolled up and held to the roof of the tent 10 using a loop and bone system.

Figure 13A:
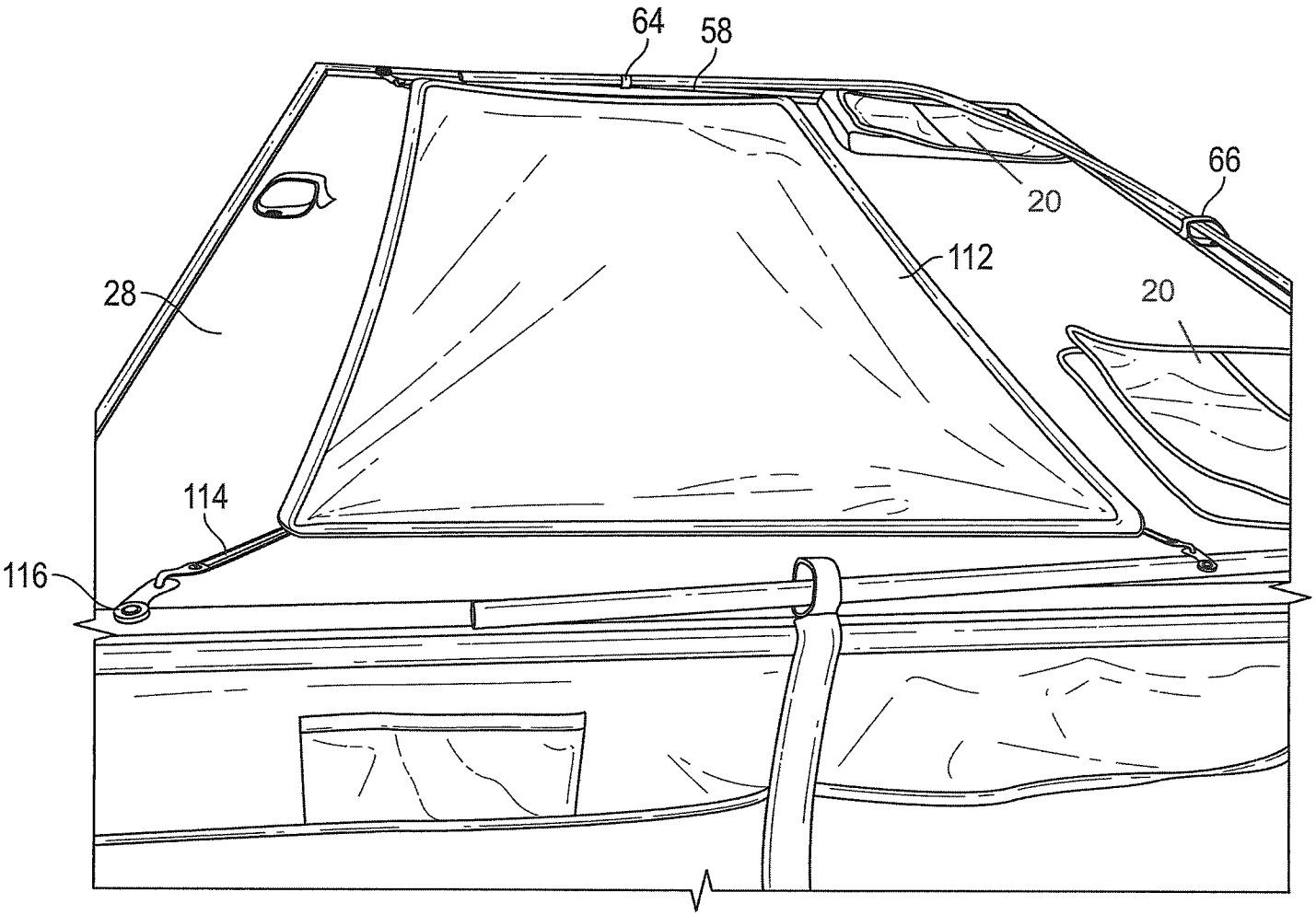
FIGS. 13*a* and 13*b* show a top view of the pivoting base portion in a stowed position, with the utility pocket in a stowed position, and the ladder not yet installed in accordance with a further embodiment of the present invention.
Figure 13B:
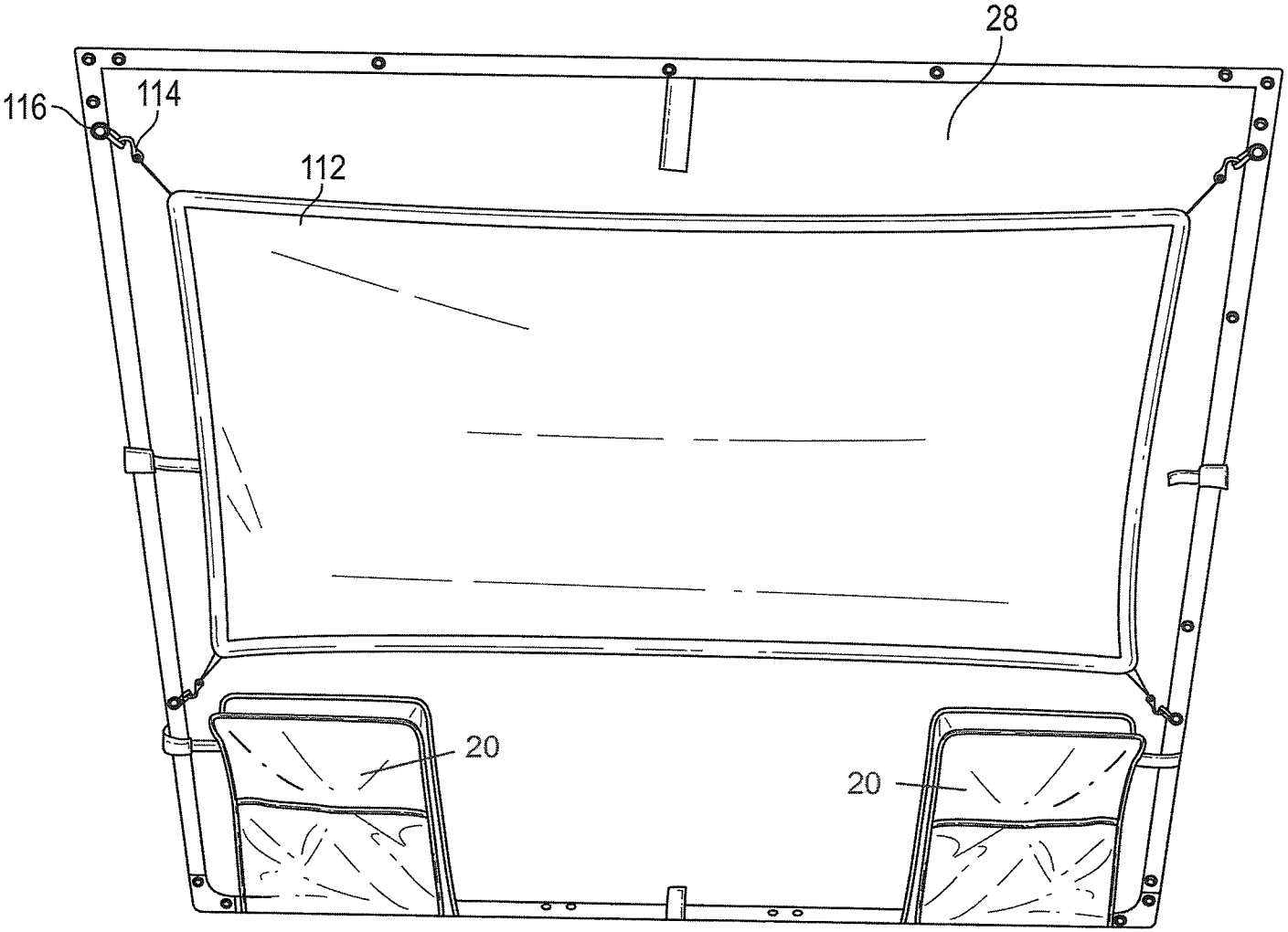

The tent 10 is also provided with a large rectangular utility pocket 112 as shown in FIGS. 13*a* and 13*b*. This utility pocket 112 is fabricated from two layers of "no-see-um" fabric, and is held in position with four bungee cords 114 or other elastic means, and some manner of removable connectors or carabiners, preferably plastic hooks with fabric loops secured to the U-channel of the base 16. The utility pocket 112 is used to secure additional parts, accessories or other camping gear in a secure position during travel.

Finally, the tent 10 is also preferably provided with the following accessories:

2 inch thick, high density foam mattress;

removable cotton mattress cover;

Unisex emergency urinal; and

D-ring 116 for hanging lighting (see FIG. 4).

While particular embodiments of the present invention have been shown and described, it is clear that changes and modifications may be made to such embodiments without departing from the true scope and spirit of the invention.

All citations are hereby incorporated by reference.

What is claimed is:

1. A vehicle roof-mounted tent comprising:

a base including a fixed portion for mounting on the roof of the vehicle and a pivoting portion connected to the fixed portion, arranged to pivot away from the vehicle;

a main tent portion, generally of tent fabric, supported by a pivoting frame, the main tent portion being positioned over the fixed and pivotal portions of the base;

a canopy portion, generally of tent fabric, extending beyond the end of the pivoting portion of the base;

an access ladder, a top end of the access ladder bearing against an edge of the pivoting portion of the base in a deployed orientation; and a shoe/utility bag, suspended from the edge of the pivoting portion of the base, adjacent to the access ladder.

2. The tent of claim 1 further comprising a rain fly, positioned over the main tent portion and the canopy portion.

3. The tent of claim 2 wherein:

the main tent portion comprises two windows on a roof surface to serve as skylights; and the rain fly comprises two PVC windows positioned above the two windows on the roof surface of the main tent, serving as skylights.

4. The tent of claim 1 wherein the base comprises:

an aluminum honeycomb material; and a U-channel fixed about the perimeter of the aluminum honeycomb material.

5. The tent of claim 1 wherein the main tent portion and the canopy portion, in combination, comprise an aerodynamic, curved profile.

6. The tent of claim 1, wherein the shoe/utility bag and the access ladder are sheltered by the canopy portion.

7. The tent of claim 6, wherein the shoe/utility bag is removably connected to a groove in the pivoting portion of the base.

8. The tent of claim 7, wherein the shoe/utility bag comprises a rubber rod sewn into the top edge of the shoe/utility bag, the rubber rod being sized to slide into the groove in the pivoting portion of the base.

9. The tent of claim 1, wherein the main tent portion further comprises two large side windows.

10. The tent of claim 9, wherein the large side windows are semi-circular in shape, having a straight, horizontal bottom edge.

11. The tent of claim 10, further comprising roll-up window awnings shaped to accommodate the semi-circular shaped side windows, the roll-up window awnings being connected to the tent fabric along the complete semi-circular arc.

12. The tent of claim 1 wherein the canopy further comprises a PVC window.

13. The tent of claim 1 further comprising a removable canopy pole pivotally connected to the pivotal portion of the base, for supporting the canopy portion.

14. The tent of claim 13 further comprising loops and Velcro on the underside of the pivoting portion of the base, for storing the canopy pole while the tent is in a folded orientation.

15. The tent of claim 1 further comprising a generally rectangular utility pocket, removably connected to the underside of the pivoting portion of the base, whereby the utility may be used to store additional items while the tent is in a folded orientation.

16. The tent of claim 1 wherein the fixed portion of the base is secured to the roof of the vehicle by way of a quick release system.

17. The tent of claim 16 wherein the quick release system comprises:

slide channels connected to the fix portion of the base;

threaded rods in slidable engagement with the slide channels;

plates which may be positioned with the threaded rods passing therethrough; and knurled hand screws for removably fixing the plates in position.

18. The tent of claim 1, wherein the fixed portion of the base and the pivoting portion of the base are pivotally connected by way of a pair of brackets, the pair of brackets also serving as the pivot point for the pivoting frame.

19. The tent of claim 18, wherein the pivoting frame comprises three arcuate poles, evenly spaced apart by way of two fabric straps fixed to the extreme ends of the base.

20. The tent of claim 1, wherein the shoe/utility bag comprises a larger pocket and a smaller see-through pocket.

21. The tent of claim 1, wherein the shoe/utility bag includes a first Velcro element which mates with a second Velcro element on the bottom of the pivoting portion of the base, so the shoe/utility bag can be stowed.

22. A tent for mounting on the roof of a vehicle comprising:

a base including a fixed portion for mounting on the roof of the vehicle and a pivoting portion connected to the fixed portion, arranged to pivot away from the vehicle;

a main tent portion of tent fabric, including:

a pivoting frame;

a door; and at least one window on a roof surface to serve as a skylight;

the main tent portion being positioned over the fixed and pivotal portions of the base;

a canopy portion of tent fabric, extending beyond the end of the pivoting portion of the base;

a rain fly, comprising a PVC window positioned above the window on the roof surface of the main tent, the rain fly being positioned over the main tent portion and the canopy portion;

an access ladder having a top end pivotally connected to the end of the pivoting portion of the base; and a shoe/utility bag, suspended from the end of the pivoting portion of the base, adjacent to the access ladder.

23. The tent of claim 22, wherein the fixed portion of the base and the pivoting portion of the base are pivotally connected by way of a pair of brackets, the pair of brackets also providing pivot points for poles of the pivoting frame.

* * * * *